US008262473B2

(12) United States Patent
Civettini et al.

(10) Patent No.: US 8,262,473 B2
(45) Date of Patent: Sep. 11, 2012

(54) INTERACTIVE TOY WITH VISUAL AND AUDIO FEEDBACK

(75) Inventors: Robert J. Civettini, Chicago, IL (US); Douglas P. Snook, Libertyville, IL (US); Luke J. Orland, Chicago, IL (US); Todd M. Bailey, Chicago, IL (US); Christopher Hardouin, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 755 days.

(21) Appl. No.: 12/348,761

(22) Filed: Jan. 5, 2009

(65) Prior Publication Data

US 2009/0176545 A1 Jul. 9, 2009

Related U.S. Application Data

(60) Provisional application No. 61/019,224, filed on Jan. 4, 2008.

(51) Int. Cl.

| | |
|---|---|
| ***A63F 9/24*** | (2006.01) |
| ***A63F 9/02*** | (2006.01) |
| ***F41J 1/00*** | (2006.01) |
| ***F41J 3/00*** | (2006.01) |
| ***F41J 5/00*** | (2006.01) |
| ***F41J 7/06*** | (2006.01) |
| ***F41J 9/14*** | (2006.01) |
| ***A63B 67/00*** | (2006.01) |

(52) U.S. Cl. ..... 463/30; 463/7; 463/31; 463/32; 463/34; 463/35; 463/36; 463/37; 463/38; 273/348; 273/356; 273/357; 273/358; 273/359; 273/366; 273/367; 273/368; 273/371; 273/374; 273/375; 273/378; 273/394; 273/399; 273/404

(58) Field of Classification Search ..... 463/7
See application file for complete search history.

(56) References Cited

U.S. PATENT DOCUMENTS

| | | | | |
|---|---|---|---|---|
| 4,215,867 | A | 8/1980 | Natwick | |
| 4,470,044 | A | 9/1984 | Bell | |
| 4,689,604 | A | 8/1987 | Sokol | |
| 4,844,476 | A * | 7/1989 | Becker | 463/5 |
| 5,057,827 | A | 10/1991 | Nobile et al. | |

(Continued)

FOREIGN PATENT DOCUMENTS

| | | |
|---|---|---|
| JP | 261693 | 3/1990 |

OTHER PUBLICATIONS

English Translation of JP2-61693.

(Continued)

*Primary Examiner* — Omkar Deodhar
*Assistant Examiner* — Werner Garner
(74) *Attorney, Agent, or Firm* — Cantor Colburn LLP

(57) ABSTRACT

Disclosed herein is an amusement device, the amusement device having: a display device rotatably mounted to a structure, the display device being configured to create a plurality of images via a persistence of vision effect; a device for rotating the display device; a sensor for determining whether an object has hit one of the plurality of images; a microcontroller in operable communication with the sensor and the display device, the microcontroller changing the appearance of at least one of the plurality of images when the sensor determines that an object has hit at least one of the plurality of images.

18 Claims, 10 Drawing Sheets

U.S. PATENT DOCUMENTS 5,150,898 A 9/1992 Hochberg et al.
5,156,643 A 10/1992 Grubek
5,190,491 A 3/1993 Connelly
5,406,300 A 4/1995 Tokimoto
5,444,456 A 8/1995 Ohta et al.
5,478,077 A 12/1995 Miyahara
5,548,300 A 8/1996 Tokimoto
5,658,211 A 8/1997 Glover
5,662,333 A 9/1997 Allen
5,670,971 A 9/1997 Tokimoto
5,704,145 A * 1/1998 Hanitz ..... 40/473
5,704,612 A 1/1998 Kelly et al.
5,743,534 A 4/1998 Pan
5,748,157 A 5/1998 Eason
5,755,443 A 5/1998 Huang
5,791,966 A 8/1998 Capps et al.
5,829,755 A 11/1998 Chen
5,934,677 A 8/1999 Yiu
5,964,640 A 10/1999 Barton et al.
6,037,876 A 3/2000 Crouch
6,155,570 A 12/2000 Allison et al.
6,175,354 B1 1/2001 Bissett et al.
6,222,459 B1 4/2001 Ting
6,239,774 B1 5/2001 Altman
6,249,998 B1 6/2001 NakaMats
6,265,984 B1 7/2001 Molinaroli
6,279,912 B1 8/2001 Martin et al.
6,325,690 B1 12/2001 Nelson
6,404,409 B1 6/2002 Solomon
6,486,858 B1 11/2002 Altman
6,492,963 B1 12/2002 Hoch
6,663,464 B2 12/2003 Payne et al.
6,719,607 B2 4/2004 Aldred et al.
6,780,078 B2 8/2004 Hageman et al.
6,894,663 B1 5/2005 Altman
6,917,282 B2 7/2005 Giegerich
7,030,420 B2 4/2006 Shimomura et al.
7,072,621 B1 7/2006 Engstrom et al.
7,079,042 B2 7/2006 Reim
7,096,046 B2 8/2006 Shapiro et al.
7,142,173 B2 11/2006 Bentley
7,161,256 B2 1/2007 Fang
7,165,857 B2 1/2007 Fong
7,236,146 B2 6/2007 Smedley et al.
7,278,934 B2 10/2007 McBride et al.
2003/0176214 A1 9/2003 Burak et al.
2005/0230919 A1 10/2005 Metcalf
2005/0231499 A1* 10/2005 Wang et al. ..... 345/207
2006/0211331 A1 9/2006 Trageser
2006/0277571 A1* 12/2006 Marks et al. ..... 725/37
2006/0287137 A1 12/2006 Chu
2007/0021203 A1* 1/2007 Edwards ..... 463/30
2007/0176368 A1 8/2007 Lamberti et al.

OTHER PUBLICATIONS

International Search Report of the International Searching Authority dated Jun. 1, 2009 for PCT/US2009/030137.
Written Opinion of the International Searching Authority dated Jun. 1, 2009 for PCT/US2009/030137.

* cited by examiner

INTERACTIVE TOY WITH VISUAL AND AUDIO FEEDBACK

CROSS REFERENCE TO RELATED APPLICATIONS

This application claims the benefit of U.S. Provisional Application Ser. No. 61/019,224, filed Jan. 4, 2008, the contents of which are incorporated herein by reference thereto.

BACKGROUND

Play sets for toy vehicles are popular toys that provide entertainment and excitement to a user or users. Furthermore, games involving launching objects into the air at a target are also popular with the user, be it a child or an adult. Children also enjoy toys that have changing visual appearances and/or sound effects. Some typical games that involve launching or throwing objects at a target include a stationary target and the game is typically over when all the objects have been thrown at the target by each player.

Accordingly, it is desirable to provide a toy wherein objects can be launched at a moving target wherein the target and its structure provide visual and audio effects.

BRIEF SUMMARY OF INVENTION

Exemplary embodiments of the present invention are directed to an amusement device and method for providing a plurality of visual targets. In accordance with one exemplary embodiment of the present invention, the amusement device comprises: a display device rotatably mounted to a structure, the display device being configured to create a plurality of images via a persistence of vision effect; a device for rotating the display device; a sensor for determining whether an object has been launched at one of the plurality of images; a microcontroller in operable communication with the sensor and the display device, the microcontroller changing the appearance of at least one of the plurality of images when the sensor determines that an object has hit at least one of the plurality of images.

In accordance with another exemplary embodiment of the present invention an amusement device is provided, the amusement device comprising: a display device rotatably mounted to a structure, the display device being configured to create a plurality of images via a persistence of vision effect; a device for rotating the display device; a sensor for determining whether an object has hit one of the plurality of images; a microcontroller in operable communication with the sensor and the display device, the microcontroller changing the appearance of at least one of the plurality of images when the sensor determines that an object has hit at least one of the plurality of images; another microcontroller disposed on the display device and in operable communication with the another microcontroller and for creating the plurality of images as the display device is rotated by the device by selectively illuminating a plurality of illuminating devices disposed on the display device; and a sound system for playing a plurality of sound effects, each of the plurality of sound effects corresponding to at least one of the plurality of images, the sound system being operated by the microcontroller.

In accordance with another exemplary embodiment of the present invention a method for providing targets, images and sound effects in an amusement device is provided, the method comprising: rotating a display device viewed through or around a structure, the display device being configured to create a plurality of images via a persistence of vision effect by selectively illuminating a plurality of illuminating devices disposed on the display device, wherein at least one of the plurality of images may be visible through an opening in the structure; and generating a plurality of sound effects, wherein at least one of the plurality of sound effects corresponds to at least one of the plurality of images; and selecting one of the plurality of images and one of the plurality of sound effects when either the sensor has detected that at least one of the plurality of images has been hit by the object or a predetermined time period has elapsed without at least one of the plurality of images being hit by the object.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein.

DETAILED DESCRIPTION OF EXEMPLARY EMBODIMENTS

Figure 1:
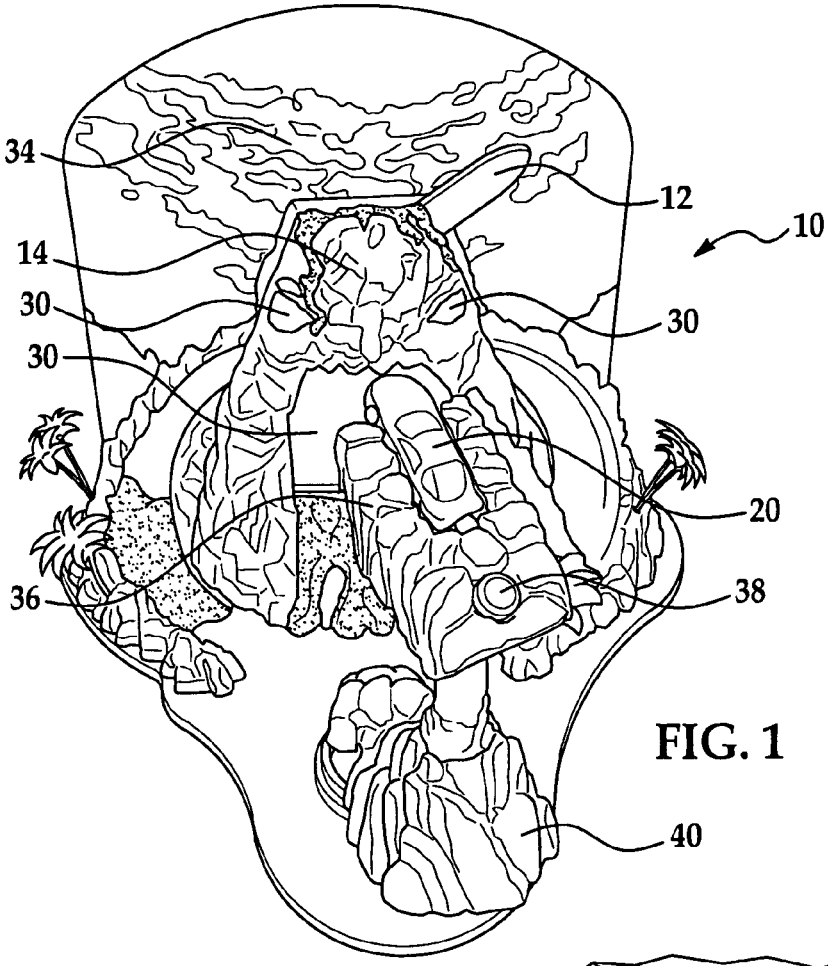
FIG. 1 is a perspective view of an amusement device constructed in accordance with an exemplary embodiment of the present invention.
Figure 2:
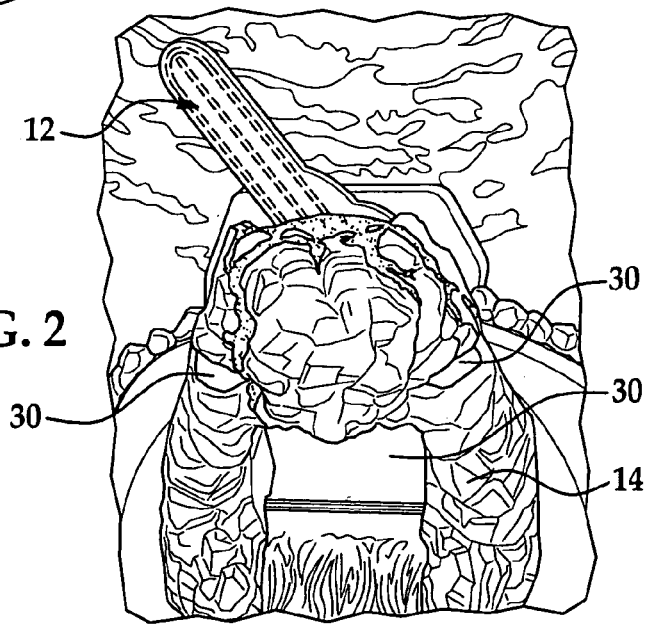
FIG. 2 is an enlarged perspective view of the amusement device illustrated in FIG. 1.

In accordance with an exemplary embodiment of the present invention an amusement device is provided wherein objects are aimed and launched at a flexible spinning wand that through persistence of vision creates a plurality of images including in one embodiment animation of creatures and menacing actions. In one non-limiting exemplary embodiment, the objects are Hot Wheels cars and the flexible spinning wand has a plurality of light emitting diodes (LEDs) for creating the animated creatures and actions.

In accordance with an exemplary embodiment of the present invention and when the car or object appears to hit or miss the target image or actually hits the spinning wand, the amusement device will recognize or record the hits and misses, resulting in loss of points or accumulation of points and the toy or amusement device may advance onto more difficult targets and/or levels depending on the recorded hits.

Referring now to FIGS. 1-10, an amusement device 10 in accordance with an exemplary embodiment of the present invention is illustrated. As illustrated, the amusement device comprises a display device 12 rotatably mounted to a structure 14. The display device further comprises a rotational display system 16 and a sensor 18 for determining whether an object 20 has hit one of the images created by the display device and/or the display device itself.

Figure 10:
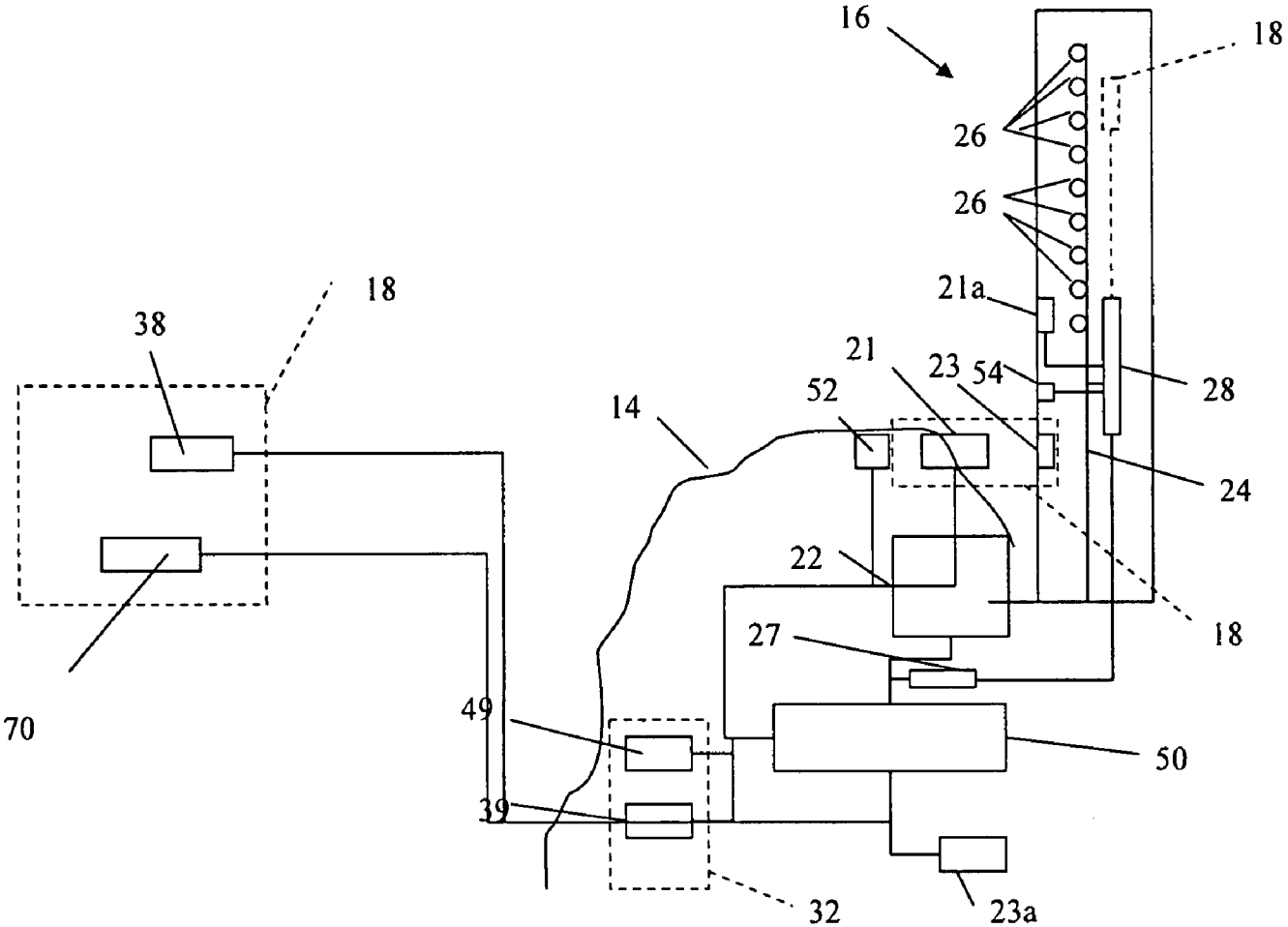
FIG. 10 is a schematic illustration of a portion of an exemplary embodiment of the present invention.
Figure 11A:
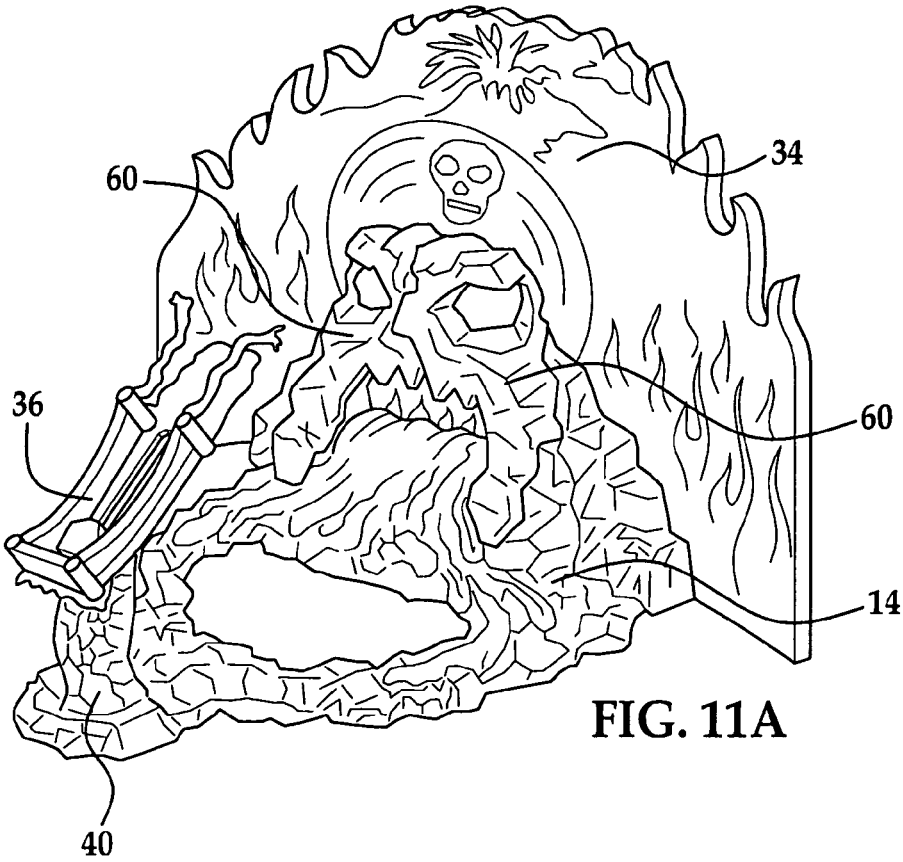
FIGS. 11A-11E illustrate an alternative exemplary embodiment of the present invention.
Figure 11B:
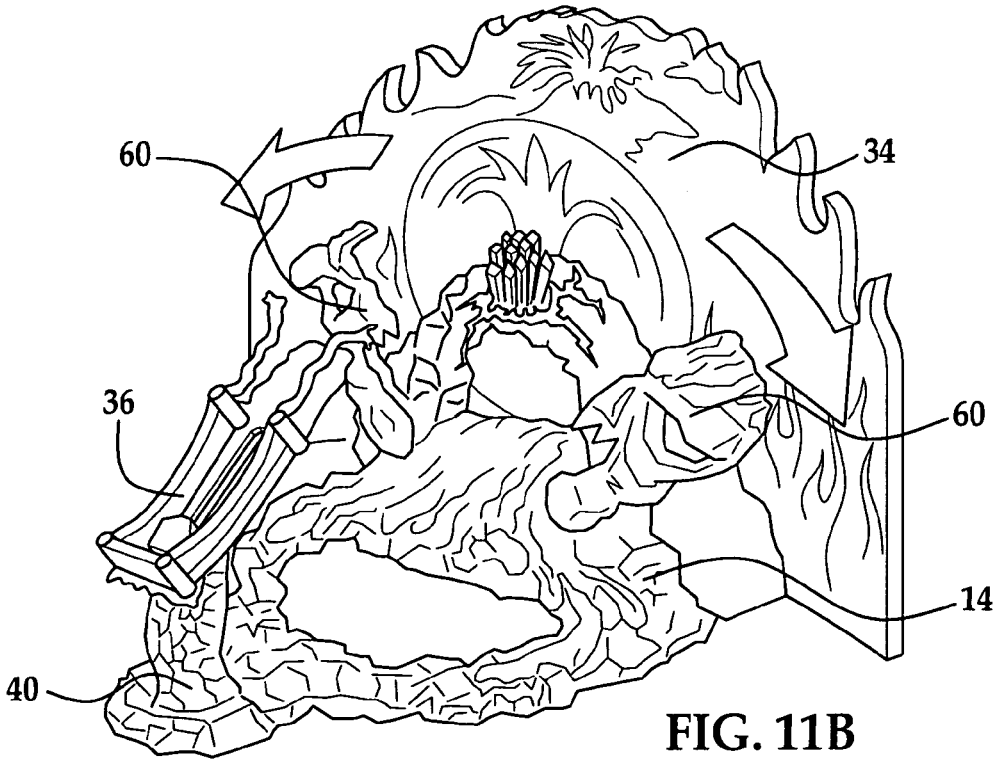
Figure 11C:
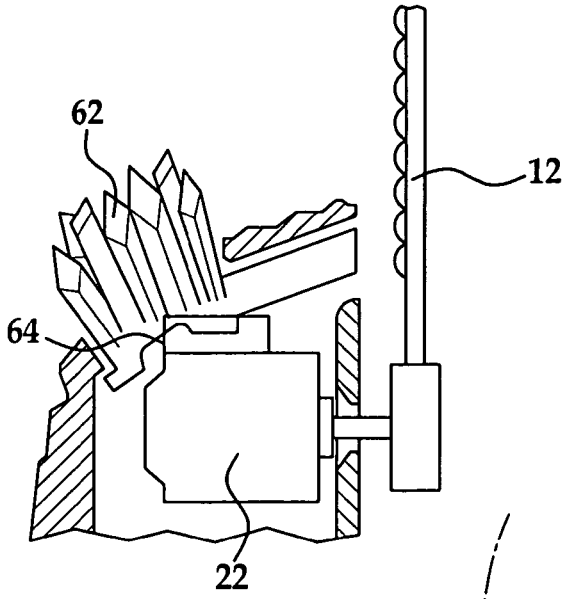
Figure 11D:
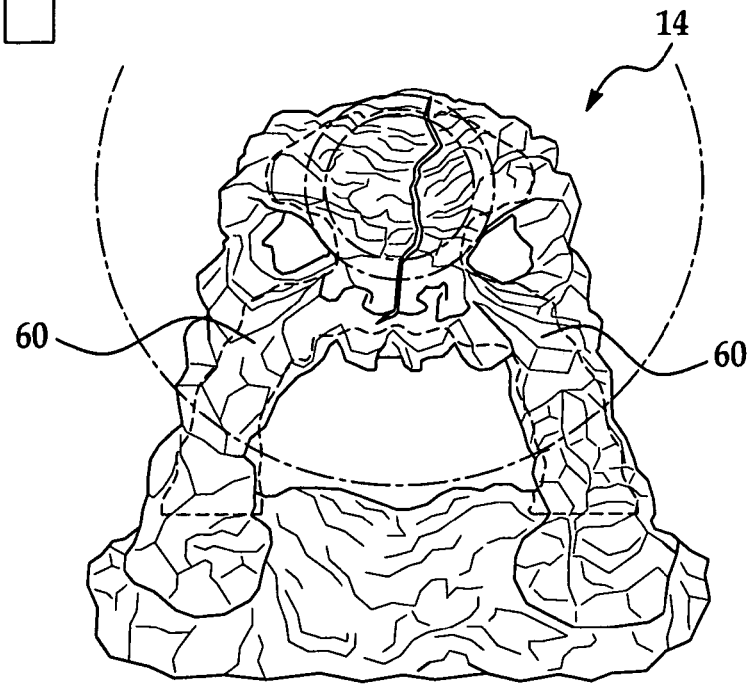
Figure 11E:
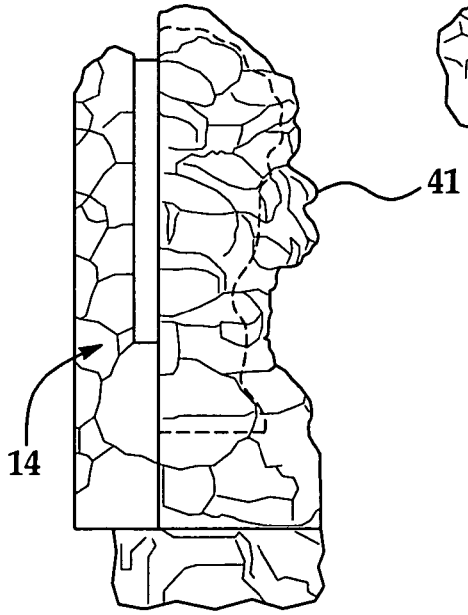

In one non-limiting exemplary embodiment, the sensor is a combination of a sensor 21 positioned to detect the presence of a source 23 secured to the rotating display device for determining a rotational speed of the device (e.g., the sensor will provide a digital or analog signal as the source is sensed by the sensor and the signal or frequency thereof is used to determine and/or regulate a rotational speed of the display device) and wherein contact of an object with the display device will cause the rotational speed of the display device to be temporarily reduced and thus indicative of an impact with the display device. This information (e.g., rotational speed) will be provided to a microprocessor or microcontroller coupled to the sensor to determine the hits of the object. A schematic illustration of this sensor is illustrated in FIG. 10. In one non-limiting exemplary embodiment, the sensor is a hall effect sensor and the source is a magnet and the digital or analog signal is activated, engaged or triggered by the magnet and the signal or frequency thereof is used to determine and/or regulate a rotational speed of the display device. Alternatively, other equivalent sensing devices are contemplated (e.g., optical sensors, inductive sensors, etc.).

In one non-limiting exemplary embodiment, the sensor is a rotational feedback sensor selected from the group comprising: hall effect sensors, physical switches, photosensors, phototransistors, quadrature encoders, systems of points and contacts and equivalents thereof wherein each of the sensors are positioned to interact with the display device in order to determine a rotational speed of the display device and wherein contact of the object with the display device will cause the rotational speed of the display device to be reduced and the rotational feedback sensor will detect the reduction in rotational speed of the display device.

In another embodiment of the present invention, the display device will comprise a second hall effect sensor 21*a* positioned on the rotating display device that is positioned to detect the presence of a magnet 23*a* positioned on the structure as the rotating display device is rotated. Sensor 21*a* is coupled to provide signals to a microprocessor of a microcontroller secured to the rotating display device for purposes of sequencing the lights in order to provide the desired images.

Alternative sensing methods are contemplated to be within the scope of exemplary embodiments of the present invention as long as the sensor is capable of determining whether the object has hit the image and/or the display device. For example, one non-limiting sensor will comprise a means for determining when the object is launched, in what direction and whether the object has been launched in the direction of the image. In this embodiment, the sensor will comprise multiple sensors for determining: i) where a launcher of the amusement device is pointing when a launch trigger of the launcher is depressed and ii) where a target image is being presented when the launch trigger of the launcher is depressed.

In another alternative embodiment, the sensor will comprise a contact sensor 18 disposed on the rotating display device and illustrated by dashed lines in FIG. 10. Here, the sensor will record hits of the object on the rotating display device.

In accordance with an exemplary embodiment of the present invention the object is a miniature car for example a HOT WHEELS car available from MATTEL.

In accordance with an exemplary embodiment of the present invention the rotational display system creates a plurality of images 29 via a persistence of vision effect wherein a rotating assembly with intermittently illuminated elements produces a polar raster display of individual, addressable pixels. The rotation of the assembly, combined with rapidly changing illuminated segments produces a series of flashing frames that blend to form a recognizable image, or series of animated images that may move around the display area. Devices that utilize persistence of vision technology receive electronic information about an image to be displayed and the information is used to synchronize the illumination of individual illuminating elements at specific positions during rotation of the assembly. In accordance with an exemplary embodiment of the present invention a planar display or wand is rotated with a plurality of LEDs. As the display member rotates, the blur perceived by the eye makes the rotating member appear to be a flat circle. This virtual circle formed by the spinning member forms a visual image wherein, brightness and timing of the illuminating sections on the member are properly synchronized.

In order to provide a rotational force to the rotational display system and in order to provide visual images, a device or motor or other equivalent mechanism 22 is provided to supply the rotational force to the display device. In an exemplary embodiment, the display device comprises a flexible circuit 24 with a plurality of illuminating devices 26 coupled to a power supply 27 wherein a microcontroller 28 in operable communication with the sensor and the plurality of illuminating devices creates a plurality of images 29 as the display device is rotated by the device by selectively illuminating a plurality of illuminating devices disposed on the display device. The power supply also providing the necessary voltage to mechanism 22 and any of the other devices requiring power (e.g., microcontrollers, sound system, leds, etc.).

As illustrated in the Figures and in accordance with an exemplary embodiment of the present invention, the structure is configured to resemble a volcano and portions of the structure have openings or orifices 30 and the rotational display system provides images above and besides the structure as well as within the openings 30. Non-limiting examples of the images include bats, spiders, ghosts, goblins, pterodactyl wings, lava bubbling and splattering, lava flows, fire and monsters as well as text. Of course, other non-limiting configurations are contemplated to be within the scope of exemplary embodiments of the present invention.

Referring now to FIG. 10, a schematic illustration of portions of the amusement device are illustrated. As illustrated, the device also comprises a sound system 32 for playing a plurality of sound effects through a speaker 39, each of the plurality of sound effects corresponding to at least one of the plurality of images. For example, the sound effects may provide the following responses: "Do you dare challenge me?"; "Go ahead, shoot your cars. I will eat them"; "Are you talking to me?"; "Prepare for your doom"; "I'm going to blow"; "Game over"; other sounds may include laughing, belching (when cars are swallowed), laughing skulls, snake hiss, tribal drum beats, shrieks, rumbles, and monster growls. In this embodiment, the sound system is controlled by a microcontroller or controller.

In accordance with an exemplary embodiment of the present invention one of the plurality of images is displayed above the structure until the object has hit the image and/or display device or a predetermined amount of time has elapsed. If an object has hit the image or display device, the sensor records the hit and the score is presented via an image provided by the rotating display device. Thereafter, another image is presented for use as a target. Alternatively, if the object misses the target the rotational display system may continue to another image and the sound system may provide a taunting response such as one of the aforementioned responses.

Also shown in FIGS. 1-9, is a screen 34. The screen is disposed behind the structure and provides at least the dual function of providing a visual backdrop corresponding to the structure as well as deflecting objects launched at the display device. Alternatively, the amusement device can be configured to be used without a screen.

In addition, the amusement device also includes a launcher 36 for launching the object at the display device. In one non-limiting exemplary embodiment, the launcher provides a means for receiving the object (e.g., car or other object) and launching the same towards the display device.

In one non-limiting exemplary embodiment, the launcher will comprise a spring powered plunger that is released by a trigger or button 38 disposed on a surface of the launcher, wherein the launcher can be aimed at the target and upon actuation of the trigger the object will be launched at the target. It being understood that other equivalent types of biasing mechanisms are contemplated for launching the car or object at the image non-limiting examples include elastic biasing members, rubber bands, mechanical actuators, solenoids and equivalents thereof. In accordance with an exemplary embodiment of the present invention, the launcher will be pivotally or movably mounted to a pedestal 40 thus allowing the object to be aimed at the target. As will be discussed herein the launcher will also comprise a means for determining where the launcher is aimed and when the launcher is activated thus, providing an indication if the object is launched at the target and whether it was pointed in the correct direction.

Figure 3:
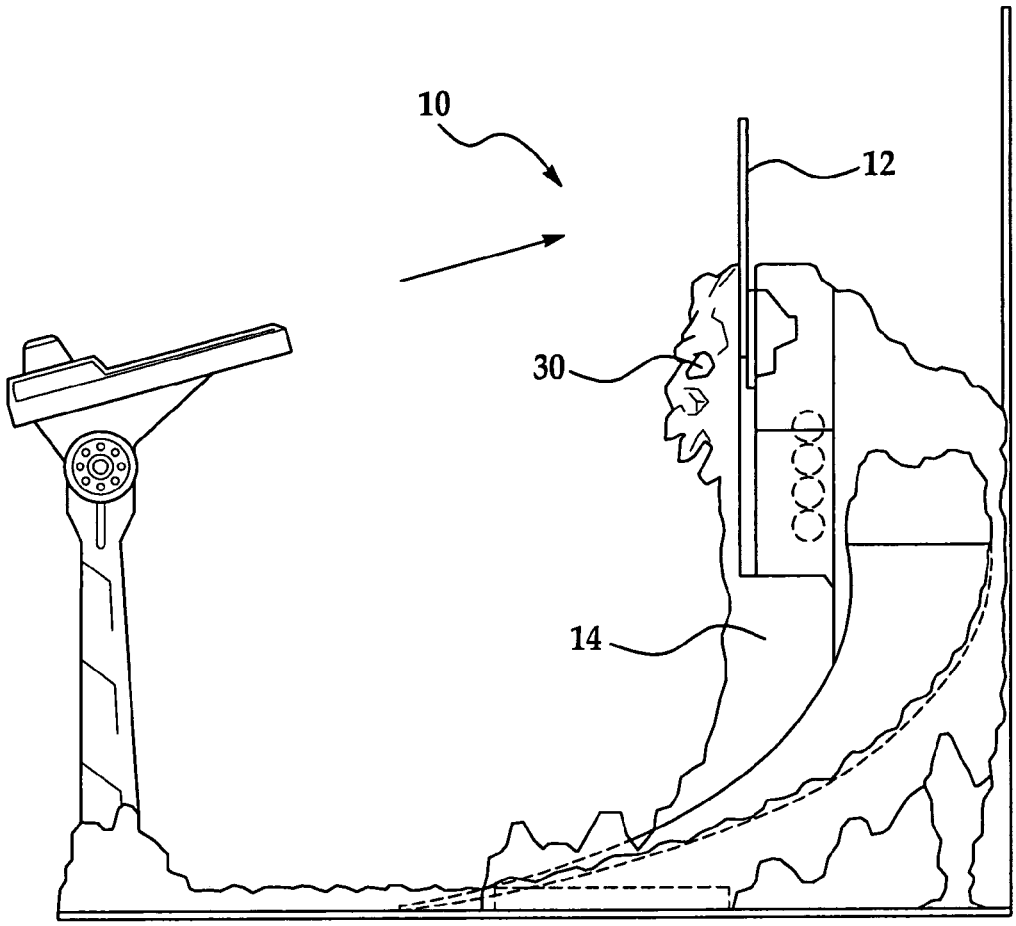
FIG. 3 is a side view of an amusement device constructed in accordance with an exemplary embodiment of the present invention.
Figure 4:
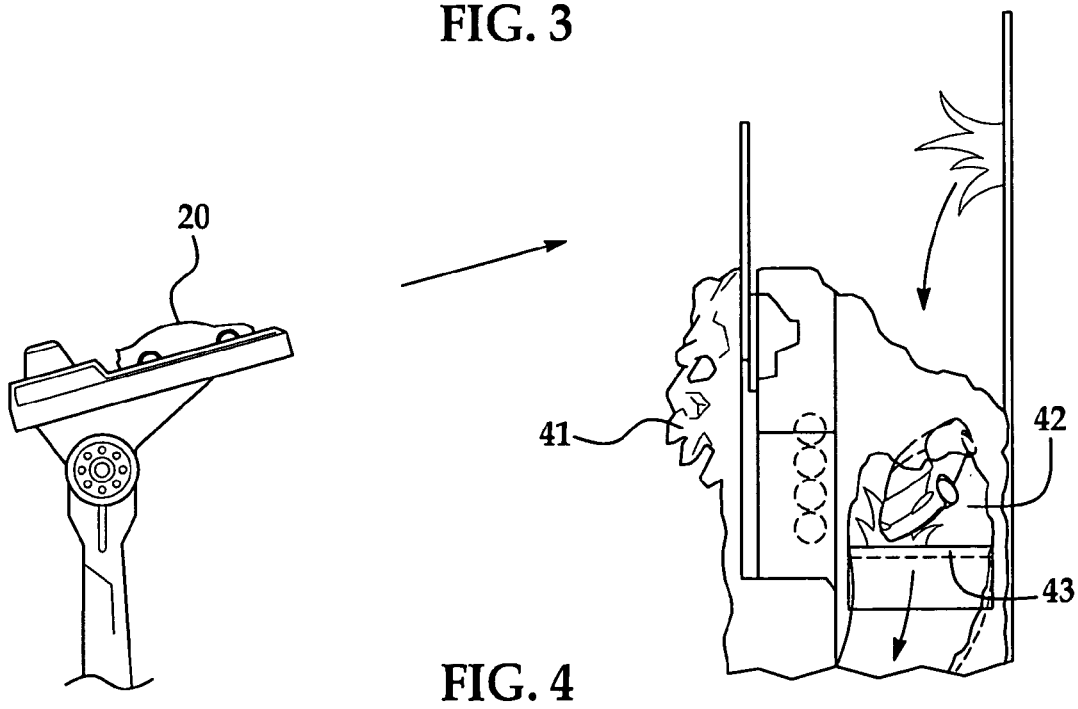
FIG. 4 is a side view of a portion of an amusement device constructed in accordance with an exemplary embodiment of the present invention.
Figure 5:
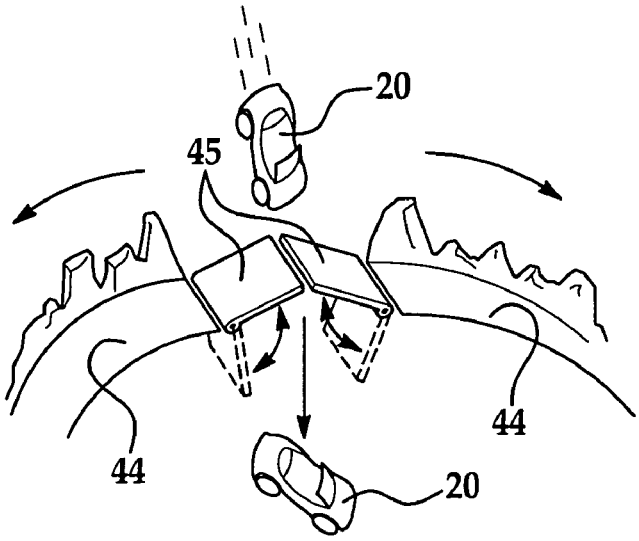
FIG. 5 is a perspective view of a portion of an amusement device constructed in accordance with an exemplary embodiment of the present invention.
Figure 6:
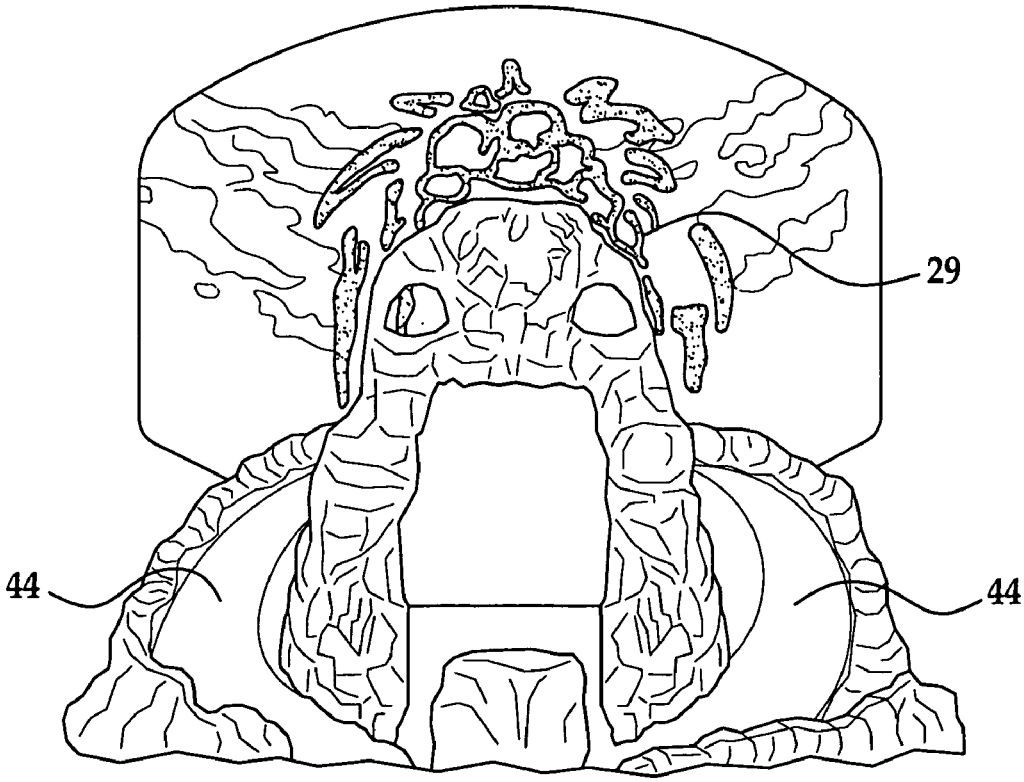
FIGS. 6-9 are front views illustrating images of an amusement device constructed in accordance with an exemplary embodiment of the present invention.
Figure 7:
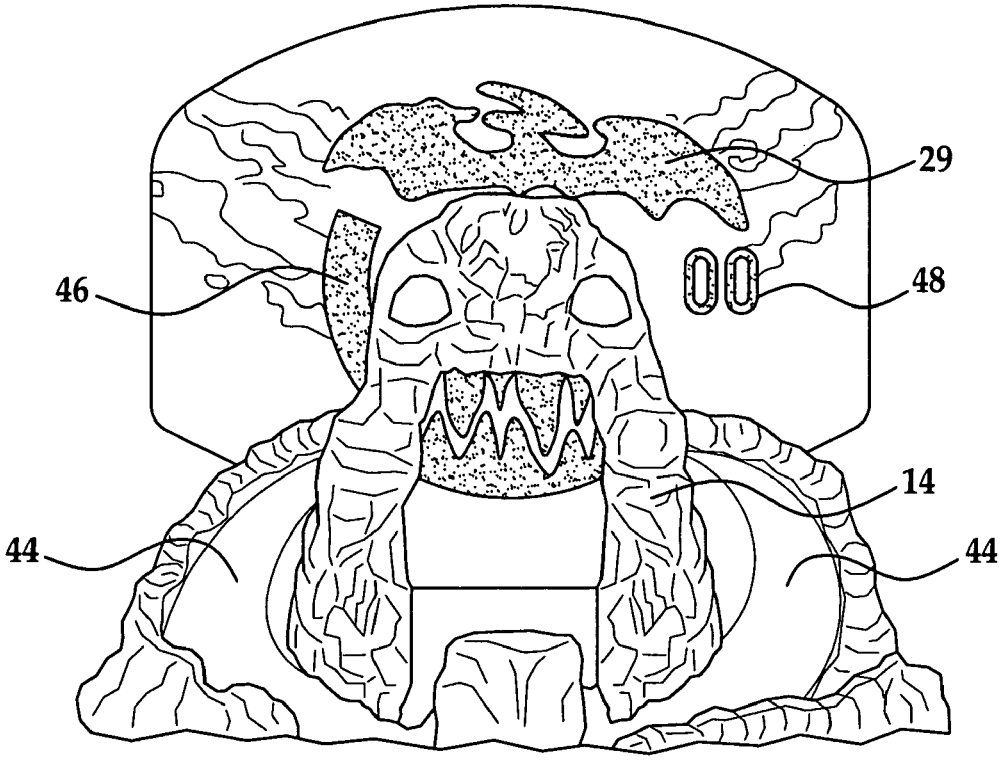
Figure 8:
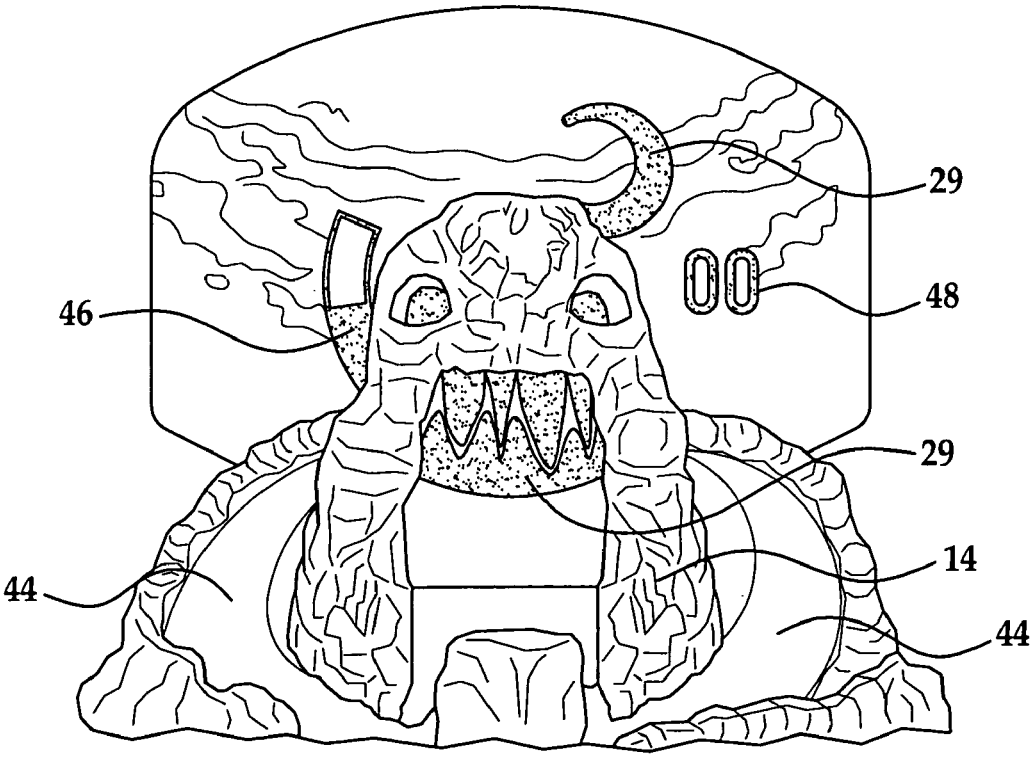
Figure 9:
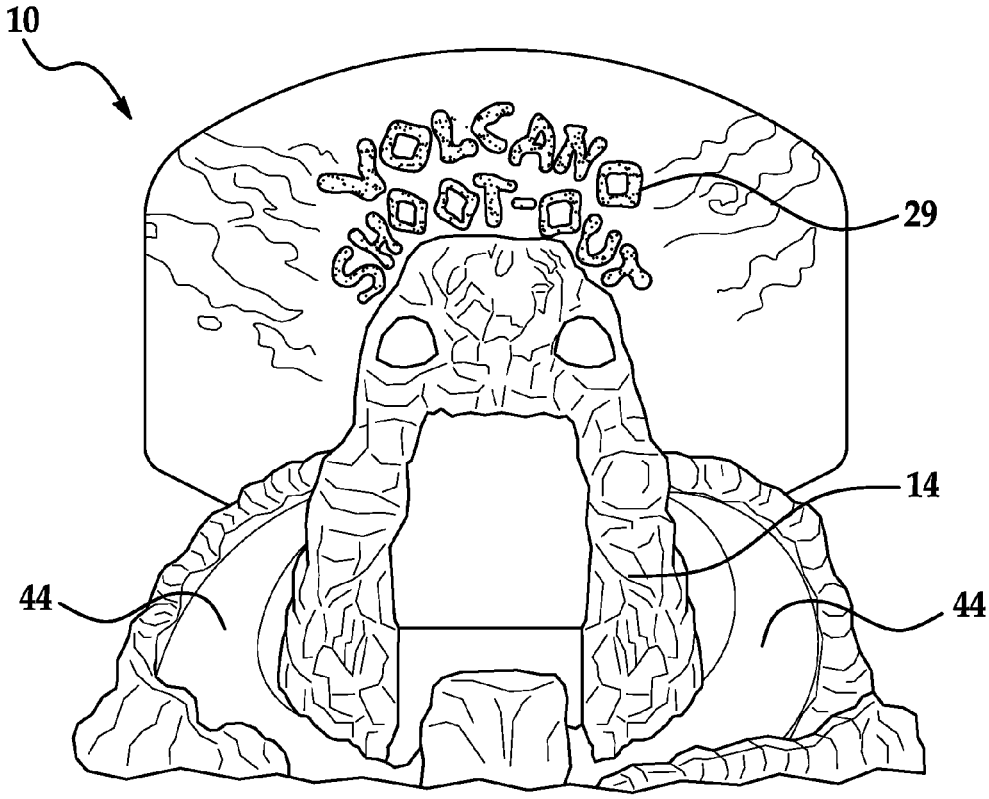

In one non-limiting alternative exemplary embodiment of the present invention and referring now to FIGS. 3 and 4 the structure will further comprise a cavity 42 disposed behind a front façade 41 of the structure such that objects that miss the target are deflected by the screen back towards the cavity and are retained there until one of a plurality of predetermined events occurs. Of course, the structure can be configured to not have a cavity disposed behind the front façade. Non-limiting examples of such predetermined events are the end of the game (time elapsed), target being hit and any other contemplated event wherein the captured objects will be released through one of the openings in the structure by pivoting or moving a floor member 43 of the cavity until the captured objects are released through one of the openings of the structure. Alternatively, the captured objects can be launched (spring or otherwise) into the air behind the structure after a predetermined event has occurred (e.g., completion of game or end) simulating an eruption of the volcano with the captured objects. Furthermore and in one non-limiting exemplary embodiment, the structure also comprises a pair of roads or chutes 44 disposed on either side of the structure that allow the objects to travel back to the operators after they have been shot at the target. In an alternative exemplary embodiment, the structure is configured to not have a pair of roads or chutes. In yet another alternative exemplary embodiment, a divider or pent roof is disposed behind the target and the objects will drop on the pent roof and slid or traverse back to the toy user or operator. In addition and in one alternative exemplary embodiment a trap door 45 is disposed directly above cavity 42 and is positioned to drop the objects into the cavity when the trap door is open.

Referring now to FIGS. 6-9, non-limiting examples of the images created by the rotational display system are illustrated. As shown, some of the images are positioned below and besides the structure while others are viewable through the openings or orifices in the structure. In accordance with an exemplary embodiment of the present invention, the structure resembles a volcano and some of the images provide the illusion that the volcano is erupting. Furthermore, some of the images disposed above the structure are creatures or targets that a user attempts to hit with the object. In one alternative exemplary embodiment and referring now to FIG. 8, one of the plurality of images is indicia 46 indicating how much time a user has to hit the display device (e.g., a graphical display of the time remaining) and another one of the plurality of images is indicia 48 indicating a score relative to the number of times the target has been hit by the object.

In yet another alternative non-limiting exemplary embodiment and referring back now to FIG. 10, the amusement device further comprises a microphone 49 for use with the sound system for playing the plurality of sound effects, here the sound system is configured to play one of the plurality of sound effects in response to an audio signal picked up by the microphone.

In one non-limiting exemplary embodiment of the present invention the amusement device comprises a first microcontroller 28 disposed on the display device and in operable communication with the rotational display system for creating a plurality of images as the display device is rotated by the device by selectively illuminating a plurality of illuminating devices disposed on the display device as the same is being rotated. Here, the first microcontroller 28 for the display device receives signals from the second hall effect sensor 21*a*, which is positioned to detect the presence of magnet 23*a* fixedly mounted to the structure, in order to determine the rotational speed of the display system and for purposes of illuminating the lights in sequence to provide the desired visual effect.

In accordance with known principles the hall effect sensor or sensor will provide a digital or analog signal to the microcontroller as the magnet or source is detected by the sensor (e.g., each full rotation) and an algorithm of the microcontroller can determine the rotational speed of the display device thus, the sequence of the light can operated (e.g., turned off and on) to provide the desired effect. Of course, any non-hall effect sensor or device capable of registering equivalent positional feedback is considered to be within the scope of exemplary embodiments of the present invention.

The amusement device further comprises a second microcontroller or controller or microcontroller 50 in operable communication with the first microcontroller via a transmitter 52 and a receiver 54 to provide signals to the display device instructing it to provide certain images in accordance with an exemplary embodiment of the present invention. In an exemplary embodiment, sensor 21 detects source 23 and provides a signal to the second microcontroller 50, which detects the rotational speed of the display device by counting sensor input pulses compared to an internal timer of the microcontroller while the sensor 21*a* on the display device detects source 23*a* and provides a signal to the first microcontroller 28, which detects the sensor input and uses it as a position reference to begin outputting image data to the LEDs for correct timed display. In this embodiment, the sound system is also operated by signals received from the second microcontroller and the images displayed by the rotational display system are controlled by the first microcontroller in response to the signals received from the receiver. In other words the microcontroller of the display device illuminates the light in response to the rotational speed to provide images via a persistence of vision effect while the second microcontroller or controller provides signals to the microcontroller of the display indicating what images the display is to provide. In accordance with an exemplary embodiment transmitter 52 and receiver 54 are infrared (IR) devices. Of course, other equivalent transmitting devices are considered to be within the scope of exemplary embodiments of the present invention.

In accordance with one non-limiting exemplary embodiment of the present invention, the amusement device keeps running scores that are displayed by the plurality of illuminating devices, which in one non-limiting embodiment is an LED array so that multiple users can play in multi-player mode. Alternatively other player options are available wherein no scores are provided. In addition, a lower half of the LED array rotation is used to provide further animation by for example animating eyes and a mouth through holes in structure of the device causing it to appear to talk to and taunt player.

For example and in an alternative embodiment wherein the microphone is employed, the microphone may be positioned to pick up audio from the user and provide a signal to the second microcontroller such that sound system appears to be reacting to a user's voice. Thus, the device creates the illusion that creature is talking back to you as it taunts.

As discussed above, the objects or cars are, in one non-limiting embodiment, returned via the fixed illustrated backdrop screen through one of the chutes 44 and if the player hits certain bad targets, the animated creature "keeps" the car or object shot at it wherein the kept cars or objects are received within the cavity and are not returned until the player hits a key target or defeats one of the creatures. Once released from the structure the cars or objects are dumped back through one of the openings in the structure in a fashion similar to a slot machine jackpot.

In another non-limiting exemplary embodiment, the theme of the amusement device is an angry erupting volcano on a forbidding island base with dark sky backdrop wherein simulated lava flows run through the structure and lava is visible through cracks in rock. In one default mode, one of the plurality of images are lava clouds that appear to flow from volcano top.

As part of one exemplary non-limiting game scenario, the volcano is alive and feeds on cars that are launched at the images, and will destroy the island if it is not stopped. As illustrated, the volcano has a sculpted in face that allows the LED array to be visible through openings where eyes and mouth should be and the launcher is sculpted as part of the natural rock formation. Furthermore and as illustrated, the cars or objects are returned to a player by the fixed flexible back drop that lead to ramps sculpted to look like rocky mountain paths.

In a playing mode, a user must defeat animated spiders, fire snakes, fireballs, giant bats, skulls, fire monsters, and lava monsters that are presented by the plurality of images, which are target in increasing order of difficulty to hit with an object. During play a car is used to hit creatures that are to be defeated. The car or object is also used to hit fireballs before they expand and destroy the player, or else the player loses life points.

In accordance with an exemplary embodiment of the present invention the volcano taunts the player through audio messages to launch cars to defeat it and its minions. In one embodiment and through the use of a microphone the amusement device knows when you are talking back to it and provides additional audio messages giving the appearance that it is getting angrier.

For example, if a player hits a non-point winning target (e.g., no impact is detected), the device appears to grab car by capturing it in the cavity and a speech file from the sound system announces, "I have your car!" and the car is held until the key targets (e.g., point earning targets) are defeated (e.g., hit by an object). If a player loses all their cars or objects, or loses all their allotted life points or time and the player does not defeat the volcano and it will appear to erupt and destroy the island. Alternatively, if a player defeats the game the volcano loses and it returns the held cars by releasing them from the cavity by moving a movable member providing a bottom of the cavity. In accordance with an exemplary embodiment of the present invention a numerical score is displayed in animated form similar to the other visual effects.

FIGS. 11A-11E illustrate an alternative exemplary embodiment of the present invention wherein the structure further comprises a pair of side portions 60 pivotally secured to the structure at one end and releasably secured to each other at another end such that upon successful completion of the game (e.g., a predetermined amount of hits of the images by the object), the structure or volcano splits open indicating defeat of the creatures of the volcano. In order to split the pair of side portions apart the two are releasably secured to each other by a releasably activated latch controlled by the microcontroller or controller and each side portion is spring biased such that upon release of the two side portions the pair will bias away from each other. In one embodiment and when the side portions pivot open a prize 62 is revealed, which in one embodiment may comprise a translucent material illuminated by a lighting device 64.

In an alternative exemplary embodiment and in order to record the number of hits and whether a target or image has been hit sensor 18 will be replaced with a sensor 70 that is positioned to determine the orientation of the launcher with respect to the pedestal thus giving information pertaining to the direction the object is being launched. Here the hit is recorded without the object actually hitting the display device or slowing it down. Non-limiting examples include printed circuit boards sensors (brush type or wireless) used in "joy stick" types of devices. In addition, a sensor or microswitch is positioned to be actuated by depressing the trigger or button 38 thereby providing a signal indicative of the movement of trigger 38 and when the object has been launched. As shown, schematically in FIG. 10 sensor 70 and the movement of trigger 38 are coupled to microcontroller 50 to provide signals indicative of when and in what direction is the object being launched furthermore, microcontroller 50 will have information pertaining to the location of the target image via operational protocols resident upon the microcontroller that are transmitted to microcontroller 28 via transmitter 52 and receiver 54 or any other equivalent device. For example, the microcontroller will have timing information and image information pertaining to the image being displayed and its location behind the structure and if the launcher is positioned in a corresponding direction (determined by sensor 70) and the trigger is depressed when the image is being displayed (e.g., actuation of trigger 38 at the correct time) the microcontroller will record this as a hit. Otherwise, it will be recorded as a miss. Accordingly, hits and misses are recorded without the object actually striking the display or slowing it down and the hit is recorded when the object strikes or is aimed at the image created by the (persistence of vision effect). In still another alternative exemplary embodiment, hit and misses can be recorded without actually launching an object at the image here sensor 70 and trigger 38 will determine if the launcher (which can be referred to as a gun) is aimed at the image and the trigger is depressed. In still another alternative exemplary embodiment and as a stand alone embodiment or in conjunction with any of the aforementioned embodiments, movement of the launcher is tracked by sensor 70 and this movement is tracked by the microcontroller and the microcontroller will vary the location of image based upon the movement of the launcher or equivalent device. In other words, the launcher can be used to relocated the image being shot at. Here the launcher will point at the image being targeted.

Figure 12:
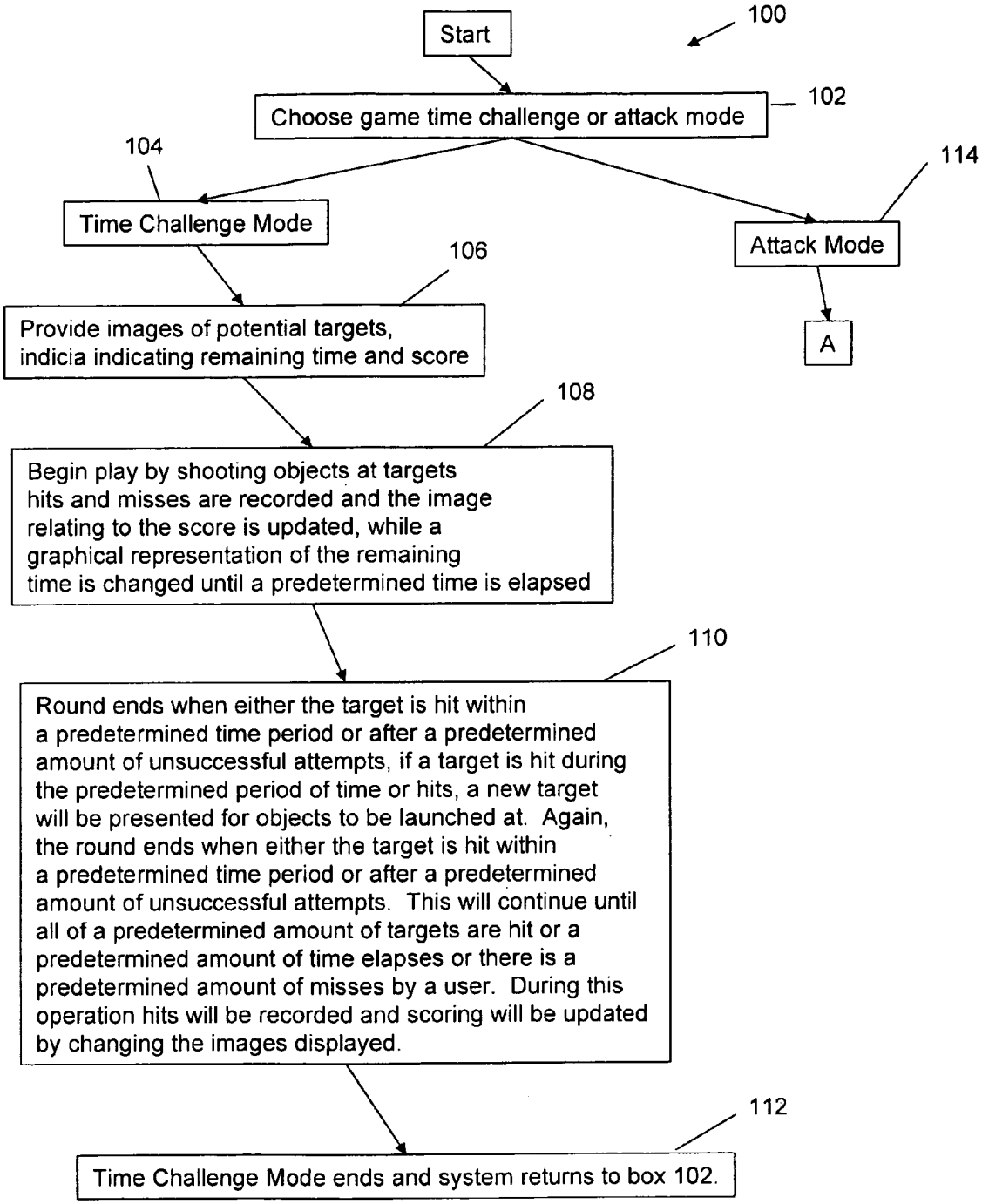
FIGS. 12 and 13 illustrate a flow chart of a portion of a control algorithm of an exemplary embodiment of the present invention.
Figure 13:
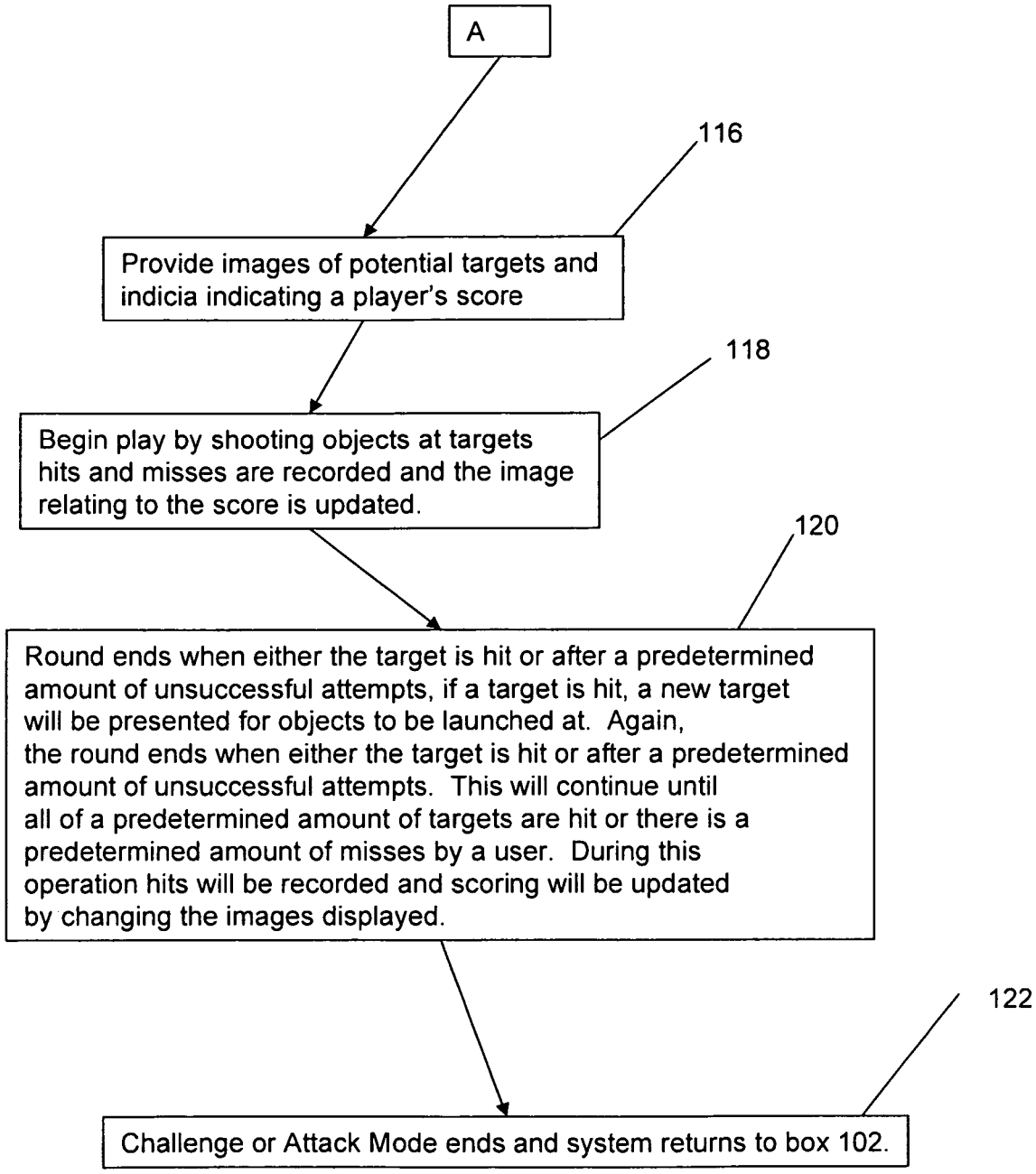

FIGS. 12-13 illustrate a flow chart 100 depicting portions of a control algorithm for a non-limiting exemplary embodiment of the present invention. In an exemplary embodiment, the algorithm is resident upon a microprocessor of a controller or microcontroller or other equivalent processing device capable of executing commands of computer readable data or program for executing a control algorithm that controls the operation of the amusement device. In order to perform the prescribed functions and desired processing, as well as the computations therefore (e.g., the execution of fourier analysis algorithm(s), the control processes prescribed herein, and the like), the controller may include, but not be limited to, a processor(s), computer(s), memory, storage, register(s), timing, interrupt(s), communication interfaces, and input/output signal interfaces, as well as combinations comprising at least one of the foregoing. For example, the microcontroller may include input signal filtering to enable accurate sampling and conversion or acquisitions of such signals from communications interfaces. In accordance with an exemplary embodiment of the present invention one contemplated microcontroller is an AM4EG series or AM4ED series microcontroller available from Alpha Microelectronics Corp. Of course, any other equivalent devices are considered to be within the scope of exemplary embodiments of the present invention. As described above, exemplary embodiments of the present invention can be implemented through computer-implemented processes and apparatuses for practicing those processes.

For example, at box 102 a user or player can choose between one of at least two types of games referred generically to as time challenge or attack mode. In the time challenge mode, the display device provides images of potential targets that must be hit by an object within a predetermined period of time or a predetermined number of attempts.

During this game the display device will provide indicia via one of the plurality of images indicating the remaining time and score. This is represented by box 106. At box 108 play begins by shooting objects at targets wherein hits and misses are recorded via a sensor, as discussed above, and the image relating to the score is updated while a graphical representation of the remaining time is changed until a predetermined time is elapsed.

At box 110 the game or round of the game ends when either the target is hit within a predetermined time period or after a predetermined amount of unsuccessful attempts, if a target is hit during the predetermined period of time or hits, a new target will be presented for objects to be launched at. Again, the round ends when either the target is hit within a predetermined time period or after a predetermined amount of unsuccessful attempts. This will continue until all of a predetermined amount of targets are hit or a predetermined amount of time elapses or there is a predetermined amount of misses by a user. During this operation hits will be recorded and scoring will be updated by changing the images displayed. Once completed and at box 112 the system returns to box 102.

If at box 102, the attack mode is selected (box 114), the amusement device will provide images of potential targets that are displayed by the display device. At box 118 play begins by shooting objects at targets wherein hits and misses are recorded and the image relating to the score is updated.

At box 120 the round or game ends when either the target is hit by the object or after a predetermined amount of unsuccessful attempts are recorded, if a target is hit, a new target will be presented for objects to be launched at. Again, the round ends when either the target is hit or after a predetermined amount of unsuccessful attempts. This will continue until all of a predetermined amount of targets are hit or there is a predetermined amount of misses by a user. During this operation hits will be recorded and scoring will be updated by changing the images displayed. Once the round ends at box 122, the system returns to box 122.

In the preceding detailed description, numerous specific details are set forth in order to provide a thorough understanding of various embodiments of the present invention. However, those skilled in the art will understand that embodiments of the present invention may be practiced without these specific details, that the present invention is not limited to the depicted embodiments, and that the present invention may be practiced in a variety of alternative embodiments. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated. This written description uses examples to disclose the invention, including the best mode, and to enable any person skilled in the art to practice the invention, including making and using any devices or systems. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. An amusement device, comprising:

a display device rotatably mounted to a structure, the display device being configured to create a plurality of images via a persistence of vision effect;

a device for rotating the display device;

a sensor for determining whether an object has hit one of the plurality of images;

a microcontroller in operable communication with the sensor and the display device, the microcontroller changing the appearance of at least one of the plurality of images when the sensor determines that the object has hit at least one of the plurality of images; and a screen disposed behind or in conjunction with the structure, the screen being configured to deflect the objects launched at the plurality of images created by the display device.

2. The amusement device as in claim 1, further comprising a sound system for playing a plurality of sound effects, each of the plurality of sound effects corresponding to at least one of the plurality of images.

3. The amusement device as in claim 1, wherein the structure further comprises a plurality of openings and some of the plurality of images are visible through the plurality of openings.

4. The amusement device as in claim 1, wherein one of the plurality of images is displayed above the structure until the object has hit at least one of the plurality of images or a predetermined amount of time has elapsed from when the object is first launched at one of the plurality of images and if the object has hit at least one of the plurality of images another one of the plurality of images is displayed above the structure until the object has hit the another one of the plurality of images or another predetermined amount of time has elapsed from when the object is first launched at the another one of the plurality of images.

5. The amusement device as in claim 1, wherein the structure further comprises a plurality of openings and some of the plurality of images are visible through the plurality of openings wherein the object is one of a plurality of objects and the plurality of objects that miss one of the plurality of images are received within a cavity of the structure and these objects are released through one of the plurality of openings when a movable member of the structure is released.

6. The amusement device as in claim 1, wherein one of the plurality of images is indicia indicating how much time a user has to hit one of the plurality of images and another one of the plurality of images is indicia indicating a score relative to a number of times the plurality of images have been hit by the object.

7. The amusement device as in claim 1, wherein the device is a motor and one of the plurality of images is indicia indicating how much time a user has to hit one of the plurality of images and another one of the plurality of images is indicia indicating a score relative to a number of times the plurality of images have been hit by the object and the amusement device further comprises a launcher for launching the object at the plurality of images, and the launcher comprises a sensor for determining when and in what direction the object is launched to determine if the object hits the one of the plurality of images.

8. The amusement device as in claim 7, further comprising a sound system for playing a plurality of sound effects, each of the plurality of sound effects corresponding to at least one of the plurality of images and wherein the structure further comprises a plurality of openings and some of the plurality of images are visible through the plurality of openings.

9. The amusement device as in claim 1, wherein one of the plurality of images is displayed above the structure until the object has hit at least one of the plurality of images or a predetermined amount of time has elapsed from when the object is first launched at one of the plurality of images and if the object has hit one of the plurality of images another one of the plurality of images is displayed above the structure until the object has hit the another one of the plurality of images or a another predetermined amount of time from when the object is first launched the another one of the plurality of images has elapsed.

10. The amusement device as in claim 1, wherein the amusement device further comprises a sound system for playing a plurality of sound effects, each of the plurality of sound effects corresponding to at least one of the plurality of images and the structure further comprises a plurality of openings and some of the plurality of images are visible through the plurality of openings, wherein the structure and the plurality of images when combined resemble another image and one of the plurality of images is displayed above the structure until the sensor has determined that the object has hit one of the plurality of images or a predetermined amount of time has elapsed from when the object is first launched at the one of the plurality of images and if the object has hit the one of the plurality of images another one of the plurality of images is displayed above the structure until the object has hit the another one of the plurality of images or another predetermined amount of time has elapsed from when the object is first launched at the another one of the plurality of images.

11. The amusement device as in claim 1, further comprising a microphone and a sound system for playing a plurality of sound effects, each of the plurality of sound effects corresponding to at least one of the plurality of images, wherein the sound system is configured to play one of the plurality of sound effects in response to an audio signal picked up by the microphone.

12. The amusement device as in claim 1, wherein the sensor comprises a rotational feedback sensor selected from the group comprising: hall effect sensors, physical switches, photosensors, phototransistors, quadrature encoders, systems of points and contacts, each of which is positioned to interact with the display device in order to determine a rotational speed of the display device and wherein contact of the object with the display device will cause the rotational speed of the display device to be reduced and the rotational feedback sensor will detect the reduction in rotational speed of the display device.

13. An amusement device, comprising:

a display device rotatably mounted to a structure, the display device being configured to create a plurality of images via a persistence of vision effect;

a device for rotating the display device;

a sensor for determining whether an object has hit one of the plurality of images;

a microcontroller in operable communication with the sensor and the display device, the microcontroller changing the appearance of at least one of the plurality of images when the sensor determines that the object has hit at least one of the plurality of images; and a launcher for launching the object at the plurality of images created by the display device, wherein the object is a miniature car.

14. An amusement device, comprising:

a display device rotatably mounted to a structure, the display device being configured to create a plurality of images via a persistence of vision effect;

a device for rotating the display device;

a sensor for determining whether an object has hit one of the plurality of images;

a microcontroller in operable communication with the sensor and the display device, the microcontroller changing the appearance of at least one of the plurality of images when the sensor determines that the object has hit at least one of the plurality of images;

another microcontroller disposed on the display device and in operable communication with the microcontroller and for creating the plurality of images as the display device is rotated by the device by selectively illuminating a plurality of illuminating devices disposed on the display device;

a sound system for playing a plurality of sound effects, each of the plurality of sound effects corresponding to at least one of the plurality of images, the sound system being operated by the microcontroller; and a screen disposed behind or in conjunction with the structure, the screen being configured to deflect the objects launched at the plurality of images created by the display device.

15. The amusement device as in claim 14, wherein the structure further comprises a plurality of openings and some of the plurality of images are visible through the plurality of openings and wherein one of the plurality of images is displayed above the structure until the object has hit at least one of the plurality of images or a predetermined amount of time has elapsed from when the object is first launched at one of the plurality of images and if the object has hit one of the plurality of images another one of the plurality of images is displayed above the structure until the object has hit the another one of the plurality of images or a predetermined amount of time has elapsed from when the object is first launched at the another one of the plurality of images and the structure further comprises a pair of side portions pivotally secured to the structure and releasably secured to each other such that upon the occurrence of a predetermined event, the pair of side portions are released from each other and pivot open.

16. The amusement device as in claim 14, wherein one of the plurality of images is indicia indicating how much time a user has to hit one of the plurality of images with the object and another one of the plurality of images is indicia indicating a score relative to the number of times the object has hit one of the plurality of images and the amusement device further comprises a launcher for launching the object at the plurality of images, wherein the object is a miniature car and wherein the screen is configured to deflect the objects launched at the display device into a cavity disposed behind the structure, the cavity retaining the objects until a movable member of the cavity is moved to release the objects from the cavity.

17. A method for providing targets, images and sound effects in an amusement device, the method comprising;

rotating a display device viewed through or around a structure, the display device being configured to create a plurality of images via a persistence of vision effect by selectively illuminating a plurality of illuminating devices disposed on the display device, wherein at least one of the plurality of images is visible through an opening in the structure;

generating a plurality of sound effects, wherein at least one of the plurality of sound effects corresponds to at least one of the plurality of images; and selecting one of the plurality of images and one of the plurality of sound effects when either the sensor has detected that at least one of the plurality of images has been hit by an object or a predetermined time period from when the object is first launched at one of the plurality of images has elapsed without the at least one of the plurality of images being hit by the object and wherein a screen is disposed behind or in conjunction with the structure, the screen being configured to deflect the objects launched at the plurality of images created by the display device.

18. The method as in claim 17, wherein the structure and the plurality of images when combined resemble another image and one of the plurality of images is displayed above the structure until the sensor has determined that the object has hit one of the plurality of images or a predetermined amount of time from when the object is first launched at one of the plurality of images has elapsed and if the object has hit one of the plurality of images another one of the plurality of images is displayed above the structure until the object has hit the another one of the plurality of images or another predetermined amount of time from when the object is first launched at the another one of the plurality of images has elapsed and wherein the sensor comprises a rotational feedback sensor selected from the group comprising: hall effect sensors, physical switches, photosensors, phototransistors, quadrature encoders, systems of points and contacts, each of which is positioned to interact with the display device in order to determine a rotational speed of the display device and wherein contact of the object with the display device will cause the rotational speed of the display device to be reduced and the rotational feedback sensor will detect the reduction in rotational speed of the display device.

* * * * *